US009346658B2

(12) United States Patent
Baughman

(10) Patent No.: US 9,346,658 B2
(45) Date of Patent: May 24, 2016

(54) FUEL ADDITIVE FUNNEL

(71) Applicant: Rieke Corporation, Auburn, IN (US)

(72) Inventor: Gary M. Baughman, Fremont, IN (US)

(73) Assignee: Rieke Corporation, Auburn, IN (US)

( * ) Notice: Subject to any disclaimer, the term of this patent is extended or adjusted under 35 U.S.C. 154(b) by 0 days.

(21) Appl. No.: 14/484,351

(22) Filed: Sep. 12, 2014

(65) Prior Publication Data

US 2015/0068643 A1 Mar. 12, 2015

Related U.S. Application Data

(60) Provisional application No. 61/877,033, filed on Sep. 12, 2013, provisional application No. 61/930,492, filed on Jan. 23, 2014.

(51) Int. Cl.

| | |
|---|---|
| ***B65B 39/00*** | (2006.01) |
| ***B67C 11/02*** | (2006.01) |
| *B65B 39/06* | (2006.01) |

(52) U.S. Cl.
CPC *B67C 11/02* (2013.01); *B65B 39/06* (2013.01)

(58) Field of Classification Search
CPC ..... B65B 34/06; B67C 11/02
USPC ..... 141/331, 332, 343; 215/386; 222/460
See application file for complete search history.

(56) References Cited

U.S. PATENT DOCUMENTS

| | | | | |
|---|---|---|---|---|
| 3,939,884 | A | 2/1976 | Mader | |
| 4,706,720 | A | 11/1987 | Pattison et al. | |
| 6,155,315 | A | 12/2000 | Peterson | |
| 6,752,183 | B2 | 6/2004 | Leoncavallo | |
| 7,264,027 | B2 | 9/2007 | Rosenbaum | |
| D560,105 | S | 1/2008 | McKenzie | |
| 7,464,735 | B2 | 12/2008 | Shultz | |
| 7,665,492 | B2 | 2/2010 | Burstein et al. | |
| 7,975,734 | B2 | 7/2011 | Makowiec et al. | |
| 8,469,066 | B2 | 6/2013 | Castillo | |
| 2009/0107582 | A1 | 4/2009 | Sayage | |
| 2009/0188583 | A1 | 7/2009 | Noel et al. | |
| 2009/0242432 | A1 | 10/2009 | Grebe | |
| 2013/0175237 | A1 | 7/2013 | Parks, Jr. et al. | |
| 2014/0137985 | A1 * | 5/2014 | Zitkovic et al. | 141/331 |

* cited by examiner

*Primary Examiner* — Jason K Niesz
(74) *Attorney, Agent, or Firm* — Woodard Emhardt Moriarty McNett & Henry LLP

(57) ABSTRACT

A unitary funnel which is injection-molded is used for dispensing a flowable product, such as a fuel additive, into a receptacle provided with a normally-closed capless fitment. The funnel includes an inlet portion for receiving the flowable product, an inserting end portion for insertion into the capless fitment and a body portion having a tapered hollow interior and extending between the inlet portion and the inserting end portion. The inserting end portion includes a skirt which is constructed and arranged for proper engagement with the normally-closed capless fitment so as to open that capless fitment and allow the flowable product to be dispensed into the receptacle.

18 Claims, 24 Drawing Sheets

FUEL ADDITIVE FUNNEL

CROSS REFERENCE TO RELATED APPLICATIONS

This application claims the benefit of U.S. Provisional Application No. 61/877,033 filed Sep. 12, 2013 and U.S. Provisional Application No. 61/930,492 filed Jan. 23, 2014, both of which are hereby incorporated by reference

BACKGROUND

Land vehicle fuel tanks typically include a connecting filler tube which is constructed with an open inlet which is positioned on one side of the vehicle. In earlier constructions this open inlet has been closed off from the atmosphere with a gas cap or closure of some type or style which may be optionally threaded or configured with a quarter-turn, bayonet style of connection. More recently, some of these older styles of removable gas caps have been replaced in newer vehicles from various manufacturers with a normally-closed, openable fitment or adapter. While this normally-closed, openable fitment or adapter could be considered a "cap", the fact that it is not removed as part of the fuel filling or fuel additive process suggests the use of a different term to describe this component. Another acceptable description is to refer to this openable fitment or adapter as a "capless fitment". This fitment is the key component of a capless gas tank system.

With this type of fitment or adapter (i.e. a capless inlet for the filler tube), there is no gas cap to be removed before adding fuel and/or fuel additives to the fuel tank of the vehicle. The normally-closed fitment or adapter has an internal closing flap construction which closes off the filler tube and which is first released and then pushed open upon insertion of the gas pump nozzle. The release mechanism may take on a variety of forms. The one common aspect is the need to be released as a preliminary step to the opening of the inner closing flap. What the gas pump nozzle sees is a carefully dimensioned opening as part of the capless fitment with the normally-closed closing flap. Upstream from this normally-closed flap are a pair of release projections or "buttons", similar to a ball detent and as the gas pump nozzle pushes these buttons radially outwardly, the internal mechanism of the capless fitment allows the normally-closed closing flap to open. The use of ball detent release projections is merely one style of a suitable release mechanism.

The typical construction and arrangement of a gas pump nozzle includes a long spout, often with a slight bend, whose open end size and shape are suitable in order to engage and push the release buttons found in the center bore of a capless fitment according to the exemplary embodiment. As indicated, pushing these buttons radially outwardly results in the normally-closed closing flap now being capable of being opened by continued advancement of the end of the gas pump nozzle. This then allows fuel to be added to the fuel tank of the vehicle. In the case of electing to add a fuel additive into the fuel tank of the vehicle, a similar spout or nozzle structure needs to be provided so that the buttons (or other release mechanism features) of the capless fitment can be engaged and then released and with continued advancement of the spout or nozzle, the normally-closed closing flap is opened. Capless gas tank systems of the type generally described above have been selected for use on various models of Ford, Cadillac, GMC and Volkswagen automobiles, as but some examples.

Besides the periodic additions of fuel, the vehicle operator may decide to also use one or more of the fuel additives which are currently available on the market. The types of fuel additives being discussed herein are typically marketed in a metal container or can which includes a plastic neck insert which is externally threaded and sealed closed first by a tear-out diaphragm and then by a threaded cap. In order to dispense the fuel additive from the container or can, the threaded cap must first be removed and thereafter the tear-out diaphragm is pulled free so as to open the can. In order to actually dispense the fuel additive, the can needs to be tilted or inverted and therein lies the issue with regard to possible spillage. The relatively short axial height of the extending portion of the neck insert is not suitable for opening a capless fitment provided as part of a capless gas tank system.

Even if the vehicle which is to receive the fuel additive includes a gas tank system with a removable cap, it is still difficult to invert and insert the extended portion of the neck insert into the inlet opening of the filler tube, without some spillage either on the vehicle or on the ground. This maneuver of inverting and inserting is even more challenging when the inlet opening is recessed inwardly from the outer surface of the side panel of the vehicle. The likelihood of spills has prompted some manufacturers of these types of fuel additives to include some type of elongated, tubular spout or funnel for attachment to the threaded portion of the plastic neck insert after the threaded closing cap has been removed and after any tear-out diaphragm has been pulled free. When a spout or funnel of the type described is included with the fuel additive, it is typically secured in some fashion directly to the container, often by an extension member which is secured around an upper portion of the container thereby allowing the spout or funnel to extend axially down the outer sidewall of the container.

In terms of design constraints, materials, fabrication costs, ease of manufacture and reliability, there are several important considerations relative to what constitutes a suitable spout or funnel for attachment to the neck insert or for attachment to the neck of the container if a neck insert is not used. A first consideration is the size of the connection end of the spout or funnel which preferably threads onto the threaded end of the neck insert or onto the threaded end of the container neck finish. Another consideration is the desired axial length of the funnel. A still further consideration is the diameter size of the inserting end of the funnel.

From a fabrication time and cost perspective, injection-molding of the funnel is preferred over a blow-molding process. However, the size requirement for the inserting end of the funnel, in order to be able to properly engage the release mechanism such as the release buttons of the capless fitment for opening the normally-closed closing flap, requires a generally cylindrical form for the tubular body of the funnel as it extends between the connection end and the inserting end. The molding of a generally cylindrical form, focusing now on the hollow interior, which needs to have at least a four to six inch length, is best accomplished by blow-molding. However, blow-molding as compared to injection-molding is a slower process and is a more expensive process. Therefore, in order to retain the advantages of injection-molding, current spouts or funnels have a tapered hollow interior and thus do not have the desired dimensions for use with capless gas tank systems.

A tapered hollow interior is important for core removal, an aspect of injection molding tubular forms. The degree of taper can be relatively minor, such as 1-2 degrees. Core removal can be accomplished from either end of the tubular form, or can be accomplished from each end. Even though the hollow interior may have a modified form depending on the selected manner of core removal, there is still a tapered form as part of the interior of the tubular body for the requisite core removal when injection molding. In order to obtain the desired outside diameter for the inserting end, according to the present invention, there may be resulting variations in the wall thickness of the tubular body and this wall thickness may not be uniform throughout. See FIGS. 17-21.

As used herein, terms such as "fuel" and "gas" may be used interchangeably, without trying to identify or denote any specific technical difference between these two terms. As such, either term is acceptable and the term selected is based on what is believed to be the preferred choice based on actual use, such as "fuel tank" and "gas cap". Further, as used herein, the term "additive" broadly includes automotive fluids such as fuel conditioners, supplements, cleaners, etc. It is also to be noted that the funnel construction disclosed herein is suitable for dispensing any flowable product from one source or container to another receptacle or reservoir.

SUMMARY

An injection-molded funnel (i.e. an extension spout) for use in dispensing a flowable product, such as a fuel additive into a fuel tank, is described. This injection-molded funnel is specifically adapted for use with a capless fitment associated with a capless gas tank system. The focus here is on the capless gas tank systems of land vehicles as several automobile manufacturers have replaced conventional gas tank caps with capless fitments.

In one exemplary embodiment the injection-molded funnel is constructed and arranged with three primary portions all of which are injection-molded together as part of a single-piece, unitary component. The injection-molded funnel includes a tubular member, a securing ring and a connector tab extending between the tubular member and the securing ring. The tubular member is hollow throughout its overall length with a connection end, an inserting end and a tubular body extending between the connection end and the inserting end. As disclosed herein, the securing ring and connector tab may be omitted if another manner of connection to the fuel additive container is selected.

Considering other spout or funnel construction options for use with fuel additives, one option is to create a blow-molded funnel, however this particular construction option has demonstrated price and cost issues. Nevertheless, this is the only practical fabrication method when the tubular member needs to be a generally straight cylinder in order to have the desired sizes at each end. It is also important to have a good connection between the connection end and the threaded neck of the container or to the threaded portion of a neck insert if one is used. Blow-molding has resulted in certain constructions which fail to provide a good connection to the container.

If the generally straight cylindrical tubular body is replaced with a tapered shape, focusing now on the hollow interior, then other funnel construction options exist, specifically fabricating the overall funnel by injection molding. This is the preferred fabrication method, but the tapered shape of the hollow interior of the tubular body results in an inserting end whose diameter is too small for properly engaging the release mechanism of a capless fitment of a capless gas tank system. As covered in the Background, one style of capless fitment includes two spaced apart inwardly projecting buttons or projections, each one being constructed similar to a ball detent. These two buttons or projections must be engaged by the gas pump nozzle or by the funnel, and pushed radially outwardly. The release mechanism is first engaged in order for the normally-closed closing flap of the capless fitment to be able to be opened. Opening of the closing flap occurs when abutment force from either the gasoline pump nozzle or the inserting end of a suitably designed funnel is applied. If the inserting end of the funnel is too small, these release buttons will not be engaged and released and the normally-closed closing flap will remain normally closed. The likely result is spilling a portion of the fuel additive on the side of the vehicle and onto the ground.

It is important in the design of a fuel additive funnel to have both a good connection to the fuel additive can, or at least a cooperative relationship without spillage and proper opening of the capless fitment so as to avoid spillage. Spillage might be onto the vehicle's paint or onto the ground, neither of which is acceptable. There is also a loss of product and the proper or desired amount of product is then not able to be added to the fuel in the tank.

Some vehicle manufacturers provide a funnel with new cars and trucks due in part to this need or at least a desire to occasionally add a fuel additive. Due in part to some of the size, form and fit issues as outlined above, even the spouts or funnels specifically provided with new vehicles have not been without problems. Accordingly, fuel additive manufacturers have continued to pursue improved spout and funnel constructions.

In view of the type of product which might be added and the pricing structure, unit cost of any added spout or funnel is a consideration. By creating a funnel construction which can be injection-molded, the more expensive blow-molding fabrication method is able to be replaced with a lower-cost method. By creating unique design features as part of the disclosed funnel of the exemplary embodiment, the tapered body (i.e. a tapered hollow interior) is retained while still being able to provide an inserting end with a diameter size which will properly engage the release mechanism of the capless fitment of the capless gas tank system. One unique design feature is the molding of an annular skirt around the inserting end in order to achieve the desired outside diameter size.

DESCRIPTION OF SELECTED EMBODIMENTS

Figure 1:
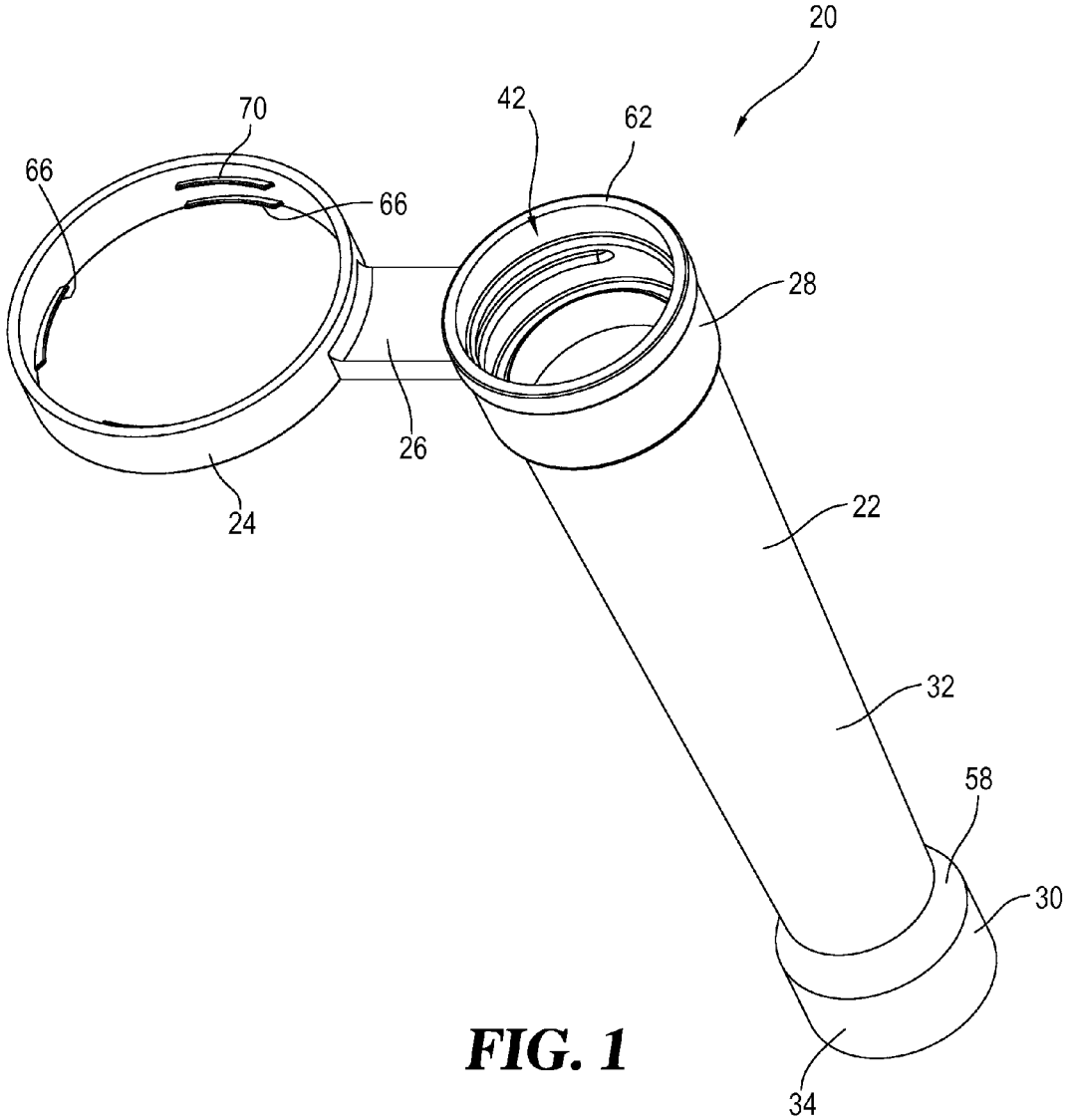
FIG. 1 is a perspective view of an injection-molded funnel according to an exemplary embodiment of the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Figure 2:
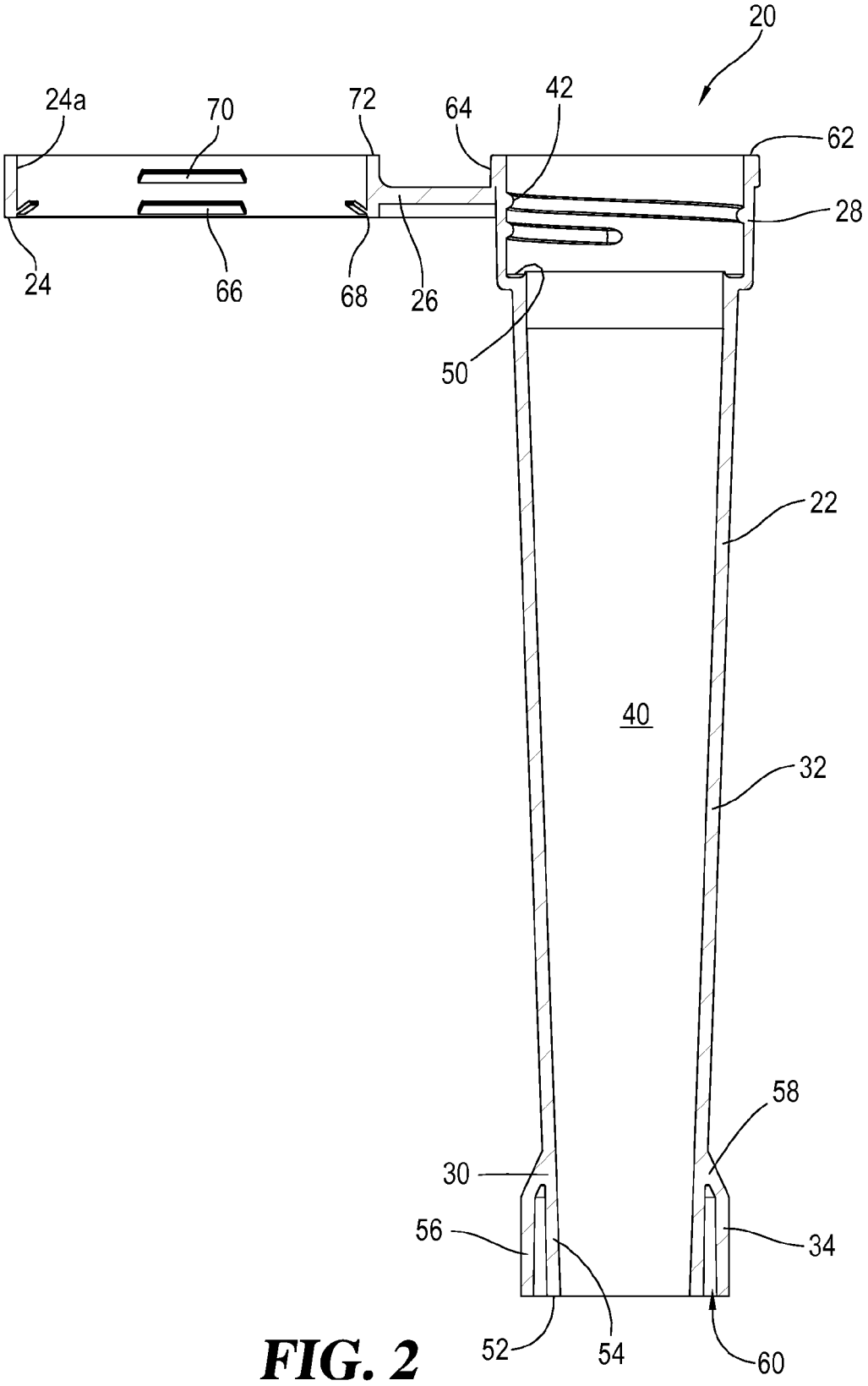
FIG. 2 is a front elevational view, in full section, of the FIG. 1 funnel.
Figure 14:
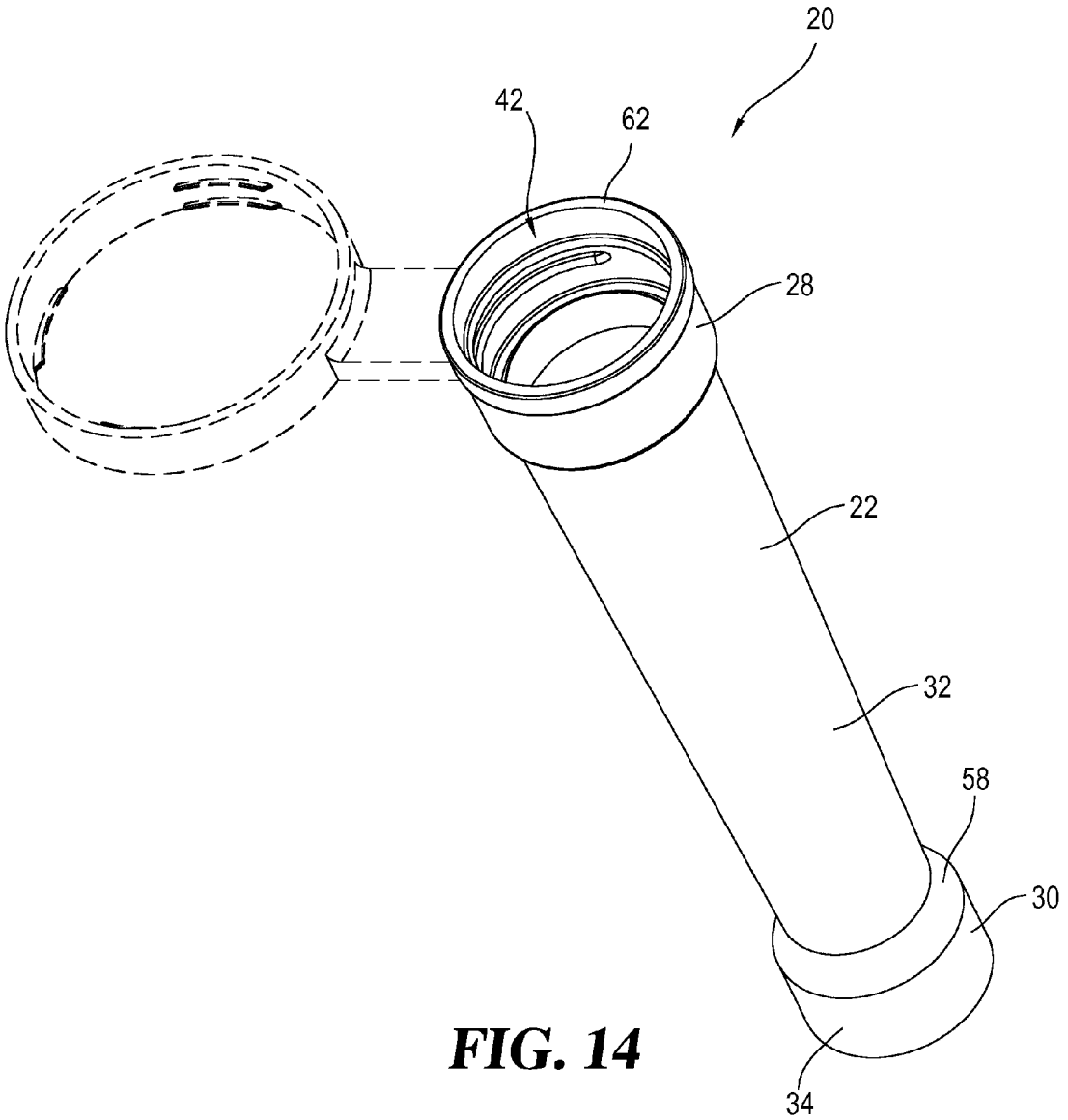
FIG. 14 is perspective view of the FIG. 1 funnel with the securing ring and its connection tab in broken line form.

Referring to FIGS. 1 and 2 there is illustrated a funnel 20 which includes tubular member 22, securing ring 24 and connector tab 26. The FIG. 1 illustration represents the exemplary embodiment wherein this funnel construction is intended for use with a fuel additive and is intended to be pre-packaged with that fuel additive. In this regard, the securing ring 24 is used for attachment to the fuel additive can and the tubular member 22 extends axially along the outer surface of the side of that fuel additive can. However, it should also be understood that funnel 20 in its most basic form would include only the tubular member 22 since the securing ring 24 and connector tab 26 are only relevant to the initial packaging and in-store display of the fuel additive. In terms of actually using funnel 20 for a flowable product, such as a fuel additive, the securing ring 24 and connector tab 26 do not provide any essential function. These two portions are only packaging related. FIG. 14 shows the securing ring 24 and connector tab 26 in broken line form consistent with this design option of supplying only the tubular member 22.

Tubular member 22 includes a connection end 28, and inserting end 30 and a hollow tubular body 32 generally extending between the connection end 28 and the inserting end 30. As would be understood from the normal or typical understanding of a "funnel", tubular member 22 is hollow throughout its entire length noting that the connection end 28 is open (i.e. hollow), the inserting end 30 is open (i.e. hollow) and the tubular body 32 is hollow. It is also to be noted that funnel 20 is injection-molded as a single-piece, unitary component and thus the tubular member 22, the securing ring 24 and the connector tab 26 could each be considered a "portion" of funnel 20. Similarly, connection end 28, inserting end 30 and tubular body 32 could each also be considered a "portion" of the tubular member 22. Importantly, disposed adjacent inserting end 30 is an annular skirt 34 which is also a "portion" of the unitary injection-molding of funnel 20, and of tubular member 22.

One design feature which contributes to the ability to injection mold funnel 20 is the tapered configuration of tubular body 32 and the tapered hollow interior 40 of that tubular body 32. Injection-molding is preferred over blow-molding for time and cost reasons. However, when the tubular body and its hollow interior are configured as a generally straight cylinder, blow-molding is the only practical fabrication technique. The focus here is on the hollow, generally cylindrical interior and how to create that hollow region as part of a molding process.

Tubular body 32 has an outer surface which is tapered uniformly with the taper of hollow interior 40. This results in a generally uniform wall thickness, at least until reaching annular skirt 34. Annular skirt 34 creates a larger outside diameter for the inserting end of the funnel as a way to compensate for the size reduction due to the tapered shape of the outer surface of tubular body 32.

The alternative embodiment of FIGS. 17-21 provides a tubular body 122 which is substantially straight (i.e., a straight cylinder). This allows the inserting end 128 to have the requisite outside diameter size without the need for any flared wall or skirt. Injection molding is still permitted as the preferred fabrication method since the hollow interior is suitably tapered for core removal. As noted, core removal may be from either end of the tubular body or from both, recognizing that the wall thickness might vary as a result.

Funnel 20 is constructed and arranged for use with a flowable product which is to be dispensed from a source, such as a container or can, into another receptacle, such as a fuel tank. In the exemplary embodiment, the flowable product is a fuel additive and the receptacle is the gas tank of a land vehicle. If the product to be dispensed is going to be added to a capped gas tank system, then almost any type of tubular spout or funnel may be suitable, assuming that the basic needs are satisfied. These basic needs would include a suitable connection between the spout and the container, a suitable size at the inserting end for entry into the filler tube once the gas cap is removed and a suitable spout length. These basic needs, associated with a capped gas tank system, permit the spout to be tapered, including a tapered hollow interior, and thereby permit fabrication by means of injection molding.

The complexity of the funnel construction increases when the funnel is to be used for dispensing a fuel additive into the gas tank when the gas tank system is a capless system. A capless gas tank system includes a capless fitment which is biased in a normally-closed condition and the closing flap which is normally-closed needs to be pushed opened for adding gasoline or for adding a fuel additive. In order to be able to push open the capless fitment of the exemplary embodiment, there are two buttons or projections configured similar to a ball detent which must be engaged. The inserting end of the spout or funnel must be able to engage and move the buttons (typically two) radially outwardly in order to release the normally-closed closing flap and allow that flap to then be moved to an open condition once it is engaged by the gas pump nozzle or by the funnel in the case of a fuel additive. Proper engagement and release of these oppositely disposed buttons requires a diameter size for the engaging member, such as the inserting end 30 of funnel 20. This required diameter size, while it needs to be large enough to engage the oppositely disposed buttons, cannot be oversized such that it will not fit into the defined inlet opening of the capless fitment. There is therefore a relatively narrow size range for the diameter size of the inserting end 30. This inserting end must be large enough to engage the buttons or other release mechanism but not too large such that it is unable to fit into the inlet opening.

In the exemplary embodiment, the desired size compromise for the diameter of the inserting end 30 ends up being relatively close to the diameter size of the connection end (24 mm connection), and accordingly, this would result in a generally cylindrical body and in turn a generally cylindrical hollow interior. The existence of a generally cylindrical hollow interior dictates the use of a blow-molding process. In order to introduce a tapered shape for the hollow interior 40 of the tubular body 32 as disclosed herein, and yet still achieve the desired diameter size for the inserting end 30, annular skirt 34 is added, see FIGS. 2 and 3. Skirt 34 creates an increase in the outside diameter size for the portion of funnel 20 which is inserted into engagement with the release mechanism of the capless fitment, such as ball-detent buttons, as one possibility. The addition of annular skirt 34 provides the necessary diameter size for engagement and release of the capless fitment buttons while still permitting a tapered shape for the hollow interior 40. Accordingly, funnel 20 becomes a suitable component for use with a capless fitment while at the same time providing a construction which may be achieved by the use of injection molding.

Figure 2A:
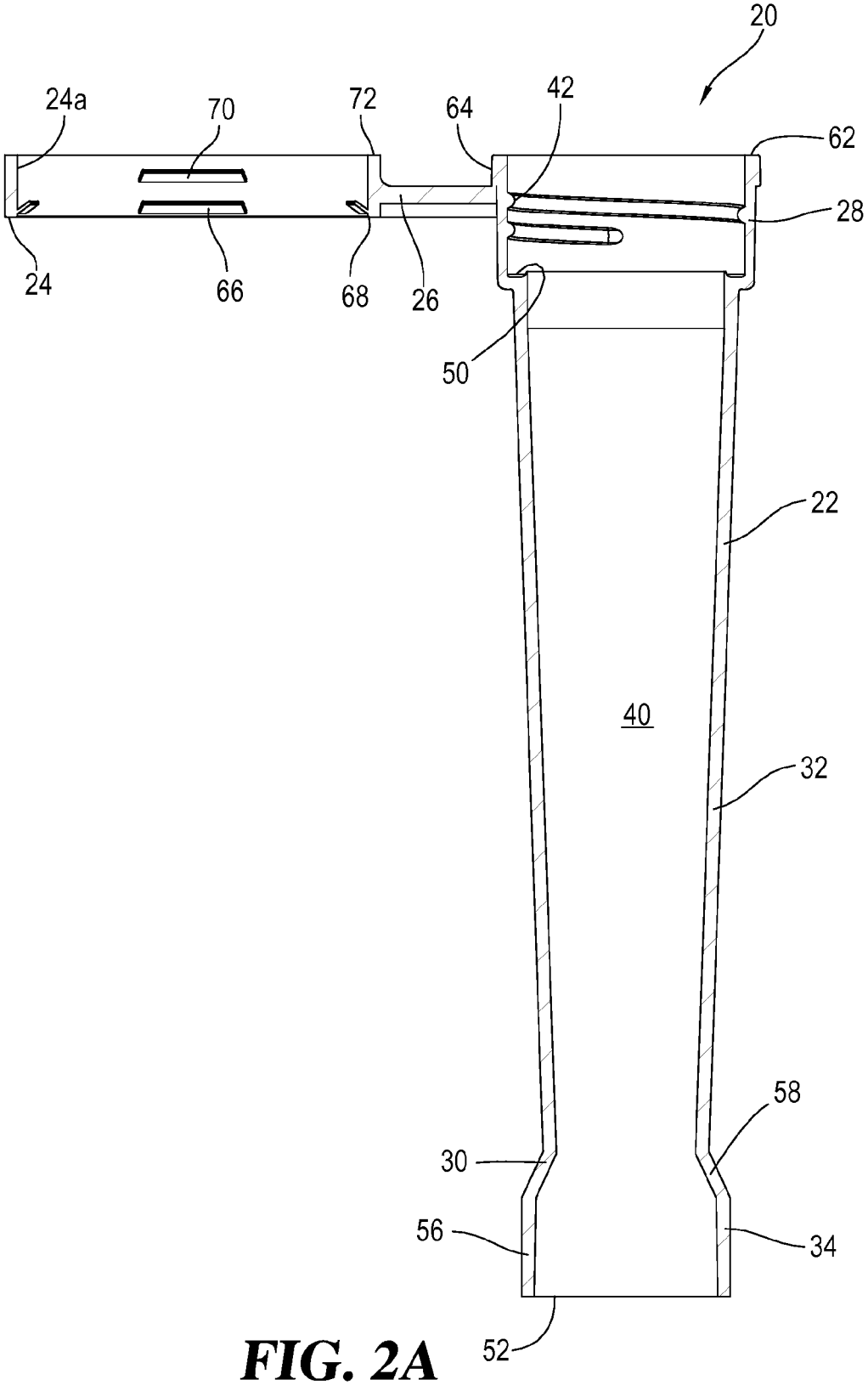
FIG. 2A is a front elevational view, in full section, of the FIG. 1 funnel without the inner wall at the inserting end of the FIG. 1 funnel.
Figure 3:
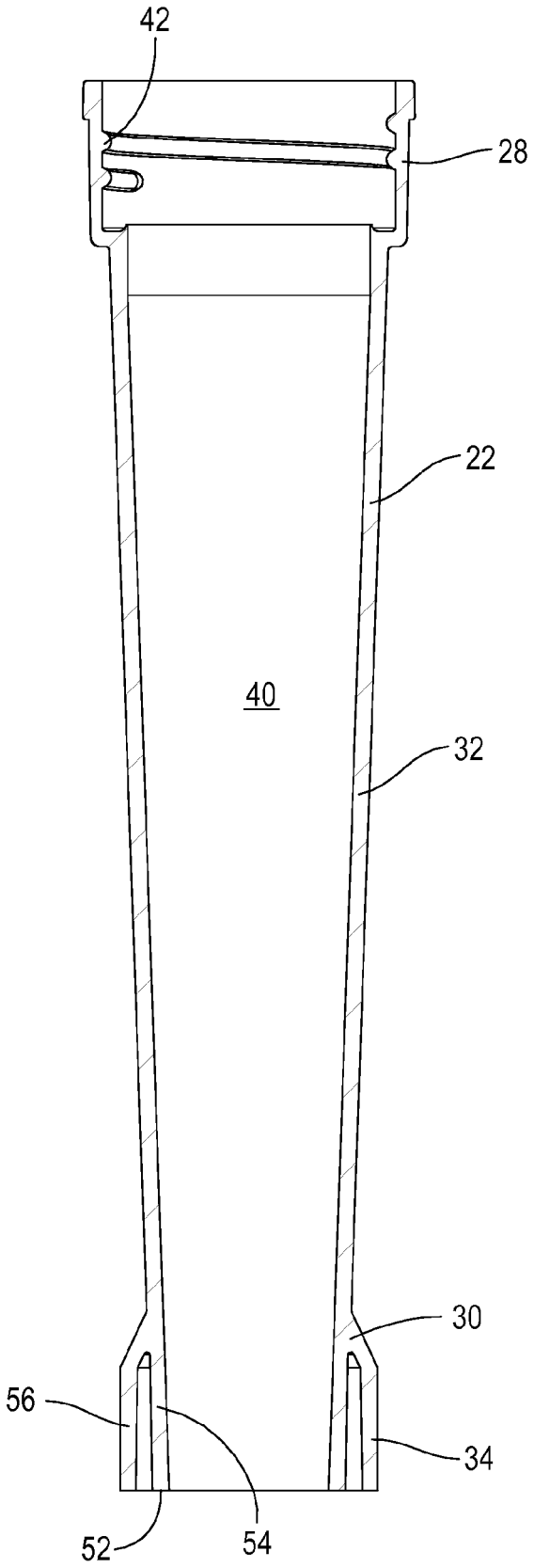
FIG. 3 is a side elevational view, in full section, of the FIG. 1 funnel, without the securing ring and connector tab which are illustrated in FIGS. 1 and 2.
Figure 3A:
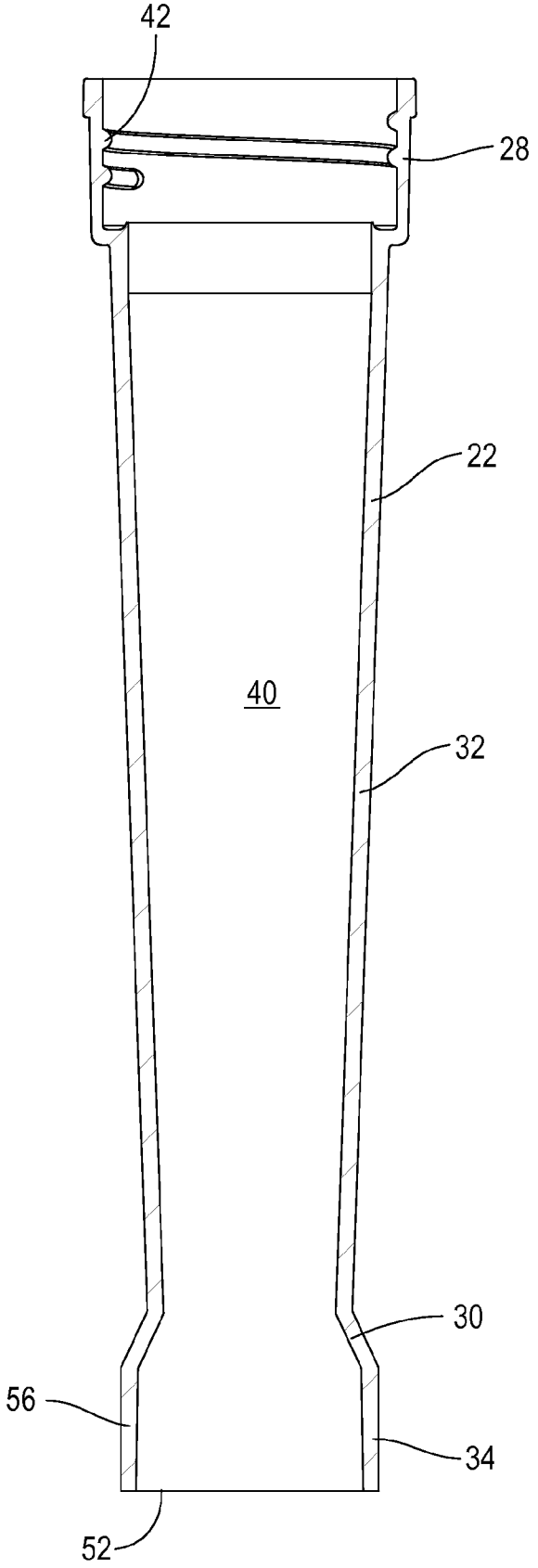
FIG. 3A is a side elevational view, in full section, of the FIG. 1 funnel, without the securing ring and connector tab which are illustrated in FIGS. 1 and 2, and without the inner wall at the inserting end of the FIG. 1 funnel.

One design variation contemplated by FIGS. 2A and 3A is to omit inner wall 54 as part of a unitary, single-piece, molded construction of the tubular body 32 of funnel 20. Since it is the outside diameter of annular skirt 34 (outer wall 56) which is the important dimension for the insertion of funnel 20 into the capless fitment, the inner wall 54 is not critical to the structure and use of funnel 20. At most, inner wall 54 provides added rigidity to the inserting end of the funnel in order to push open the biased closing flap of the capless fitment.

With continued reference to FIGS. 1, 2 and 3, the single-piece, unitary, molded plastic construction of funnel 20 is illustrated. Connection end 28 is internally threaded with a thread form 42 which is compatible with the external threads of the plastic neck insert 44 which is securely assembled into the fuel additive can 46 (or container) as the way to provide a threaded container neck finish 84. Securing ring 24 is used to attach funnel 20 to the fuel additive can 46 from the time of original fabrication and filling of the fuel additive can to the time of dispensing by the user. When the user decides to add some or all of the fuel additive into the gas tank of the vehicle, the securing ring 24 is pulled off of the can 46, the threaded cap 48 of the container is removed and connection end 28 is threaded onto the neck insert 44 in place of the threaded cap 48. If a tear-out diaphragm is provided, that diaphragm must be removed after the cap is removed. The securing ring 24 stays attached to the connection end 28 during use due to connector tab 26. Tubular body 32 extends from the base 50 of connection end 28 to the distal edge 52 of inserting end 30. As is illustrated, inserting end 30 has a double-walled construction. The inner wall 54 is a continuation of the tubular body 32 and the hollow interior 40 has a converging taper as it extends from connection end 28 to distal edge 52. The outer wall 56 corresponds to the annular skirt 34. The annular skirt 34 intersects tubular body 32 approximately 0.50 inches (12.7 mm) above the distal edge 52. The annular tapered portion 58 provides an annular space 60 between the inner wall 54 and the outer wall 56. This separation (annular space 60) between the inner 54 and outer 56 walls provides at least two benefits or improvements. First, this construction maintains a desired taper for the hollow interior 40 so as to permit fabrication of funnel 20 by means of injection molding. Secondly, this construction creates an enlarged outside diameter for the inserting end 30 so that the release buttons of a capless fitment will be properly engaged for releasing the closing flap from its normally-closed condition into an openable condition which then only requires engagement by the inserting end 30 of the funnel 20 to push open the closing flap.

The inner wall 54 and the outer wall 56 each terminate at distal edge 52 such that the surface represented by distal edge 52 is planar. The outside diameter of the inner wall 54 at distal edge 52 is approximately 0.63 inches (16 mm). The outside diameter of the outer wall 56 at distal edge 52 is approximately 0.80 inches (20.3 mm). The outside diameter of connection end 28 at its upper, exposed end 62 is approximately 1.08 inches (2.74 cm). End 62 has a wall thickness of approximately 0.062 inches (1.57 mm) and a slight radial lip 64 with an axial dimension of approximately 0.104 inches (2.64 mm). The connector tab 26 is joined to the connection end 28 at a location directly below the radial lip 64 (see FIG. 2).

As a second embodiment of funnel 20, the inner wall 54 is eliminated leaving only the outer wall 56 created by skirt 34. In this second embodiment the elimination of the inner wall 54 still retains the tapered portion 58.

Figure 4:
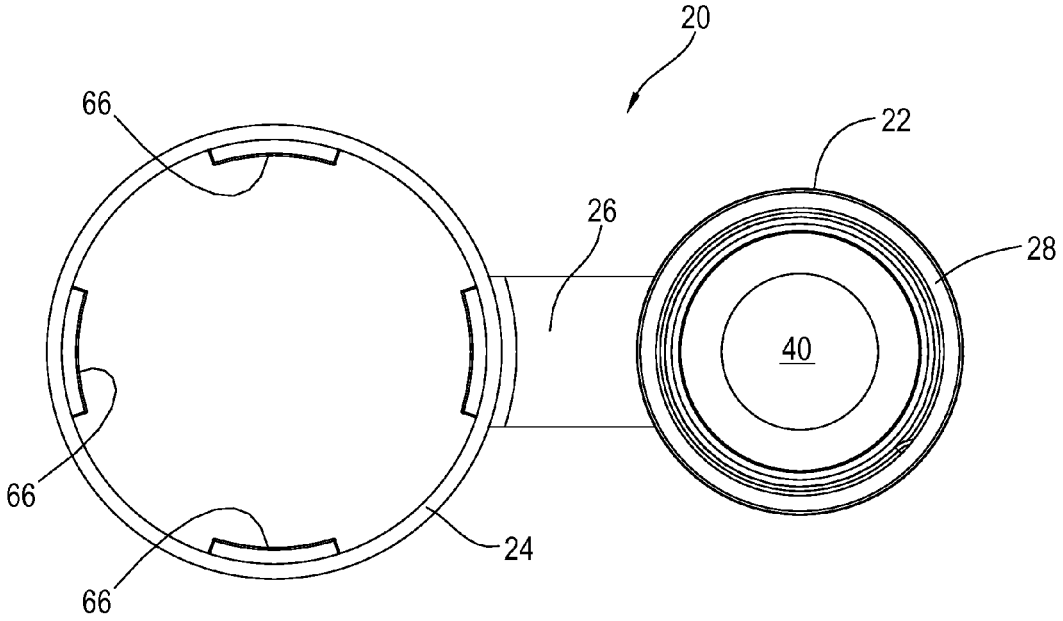
FIG. 4 is a top plan view of the FIG. 1 funnel.
Figure 5:
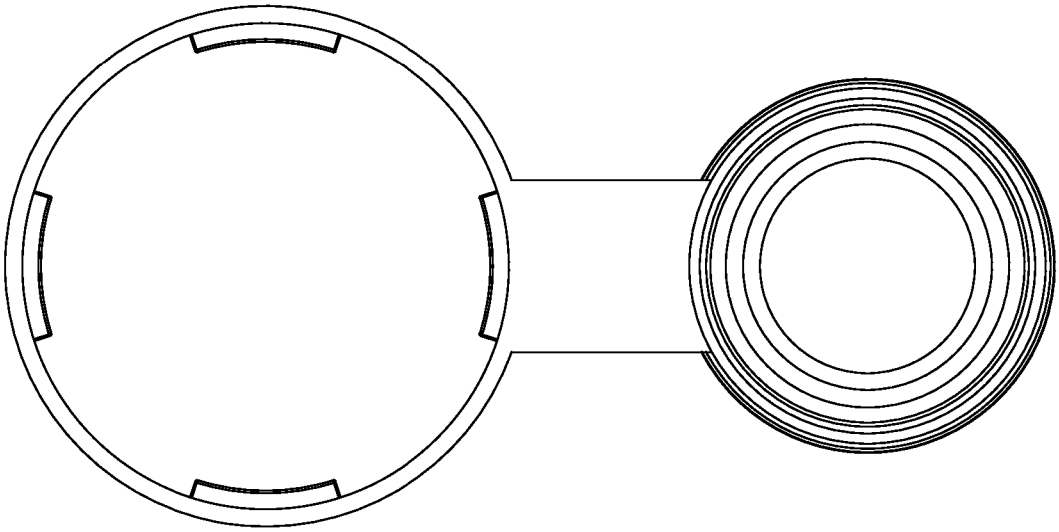
FIG. 5 is a bottom plan view of the FIG. 1 funnel.

With continued reference to FIGS. 1 and 2 and with further reference to FIG. 4, securing ring 24 includes four radially-inwardly directed tabs 66, each tab having a part-circumferential form and an upward incline. For the benefit of positional and orientation clarity, the FIG. 2 illustration shows the funnel 20 in an upright orientation. The "top" corresponds to the upper, exposed end 62 of connection end 28. The "bottom" corresponds to the distal edge 52. This is the orientation for funnel 20 which exists when the funnel is attached to the neck of a fuel additive can as it stands upright on a store shelf. Based on this orientation, the four tabs 66 of the securing ring 24 are inclined upwardly as they each extend radially inwardly. In the exemplary embodiment, the four tabs 66 are substantially equally spaced apart and each one has substantially the same sector or circumferential length around the inner surface 24*a* of the wall of the securing ring 24.

In addition to the four tabs 66 which are positioned near the bottom edge 68 of the securing ring 24, two additional abutment tabs 70 are provided, each one generally aligned with two of the other four tabs 66, as illustrated in FIGS. 1 and 2. These two abutment tabs 70 are positioned closer to the upper edge 72 of the securing ring 24. The second abutment tab 70 of the two which are provided is actually hidden from view in the drawings, but it is constructed and arranged substantially the same as the other abutment tab 70 which is in fact illustrated. These two abutment tabs 70 are of the same general shape and construction and are generally oppositely disposed one from the other on the inner surface 24*a* of securing ring 24.

Figure 6:
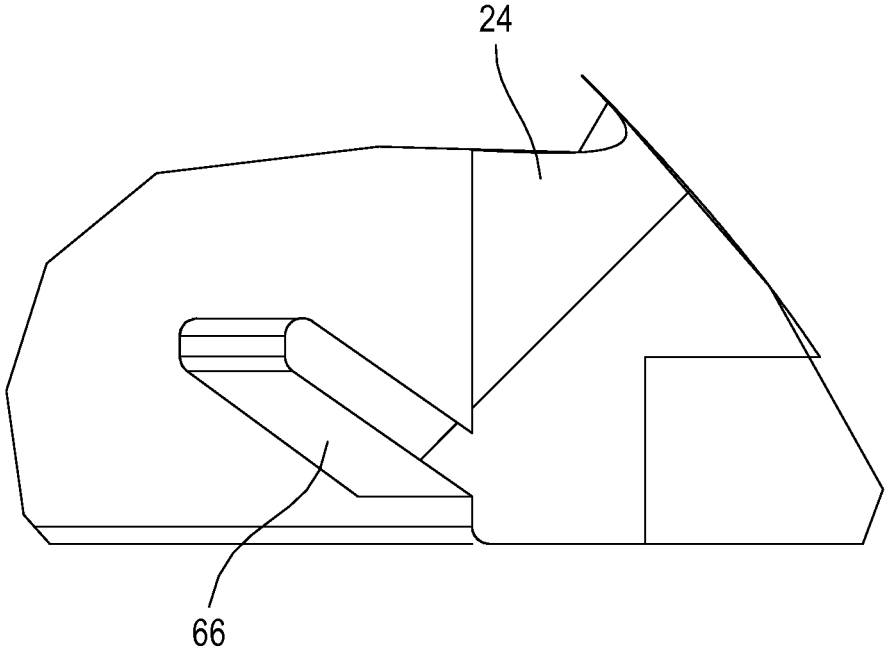
FIG. 6 is a detail illustration of a portion of the securing ring illustrated in FIGS. 1, 2 and 4.

With regard to FIG. 6, there is a enlarged illustration of one inwardly inclined and directed tab 66.

Figure 7:
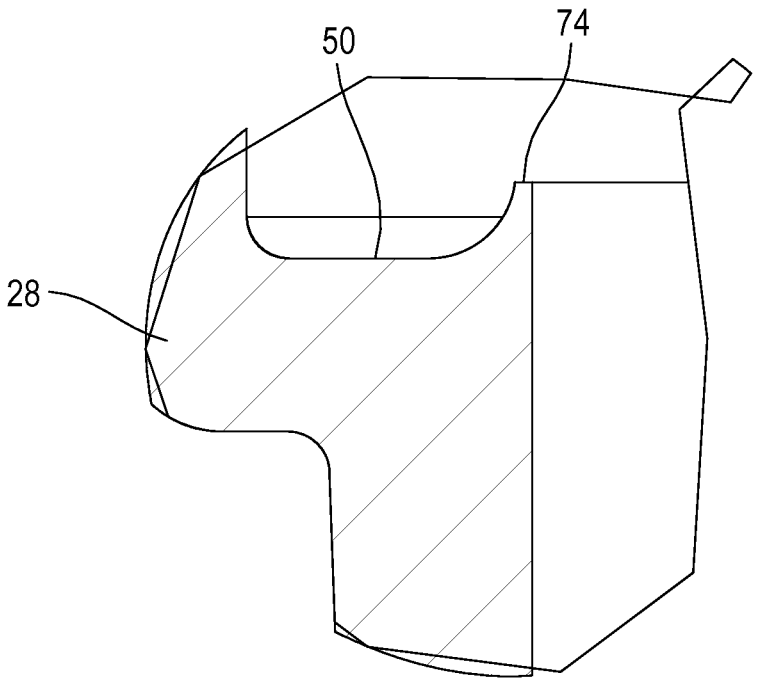
FIG. 7 is a detail illustration of one portion of the tubular member which comprises one part of the FIG. 1 funnel.
Figure 8:
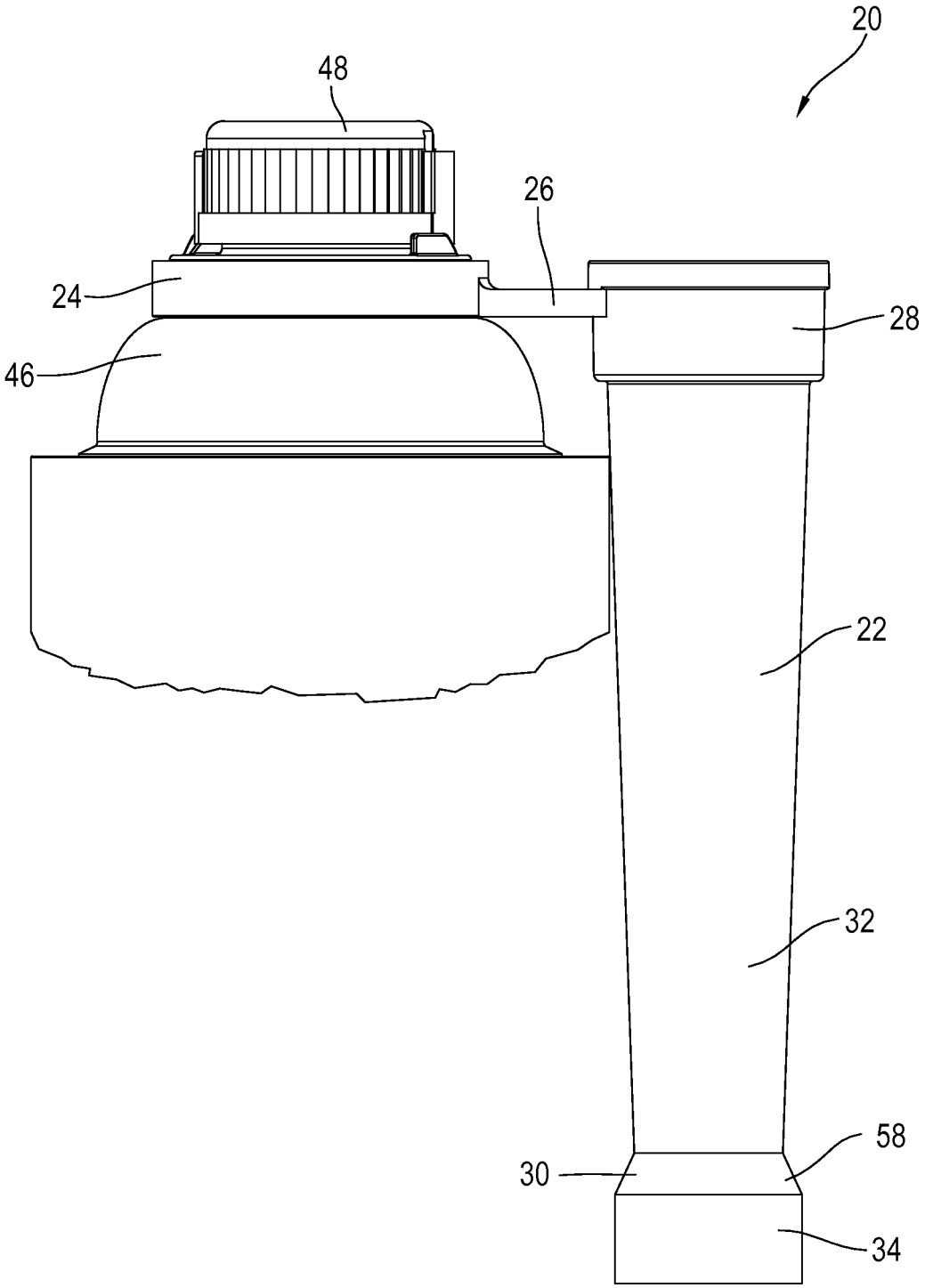
FIG. 8 is a front elevational view of the FIG. 1 funnel with the securing ring assembled to a neck insert of a fuel additive can.
Figure 9:
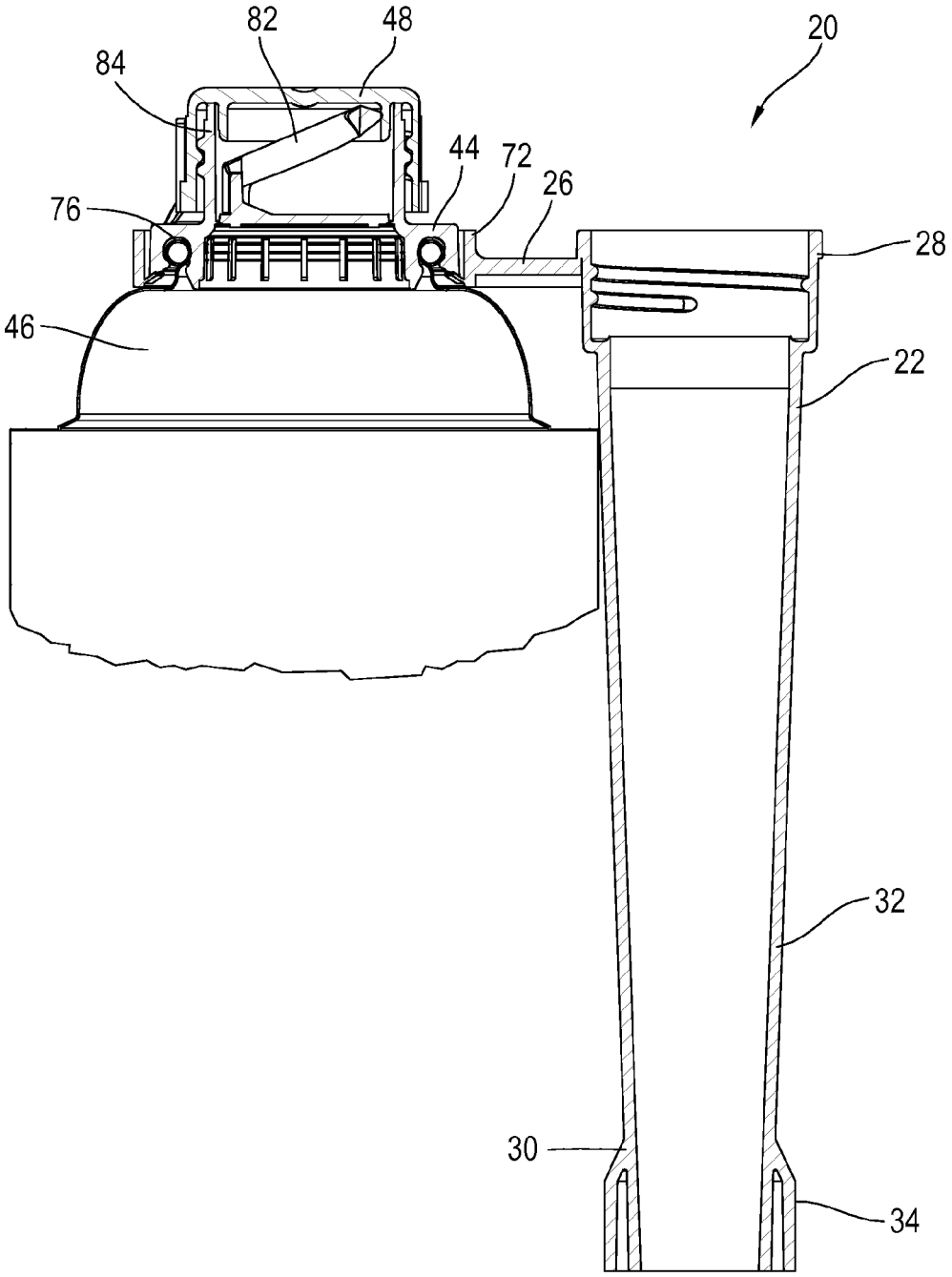
FIG. 9 is a front elevational view, in partial section, of the FIG. 8 assembly.
Figure 10:
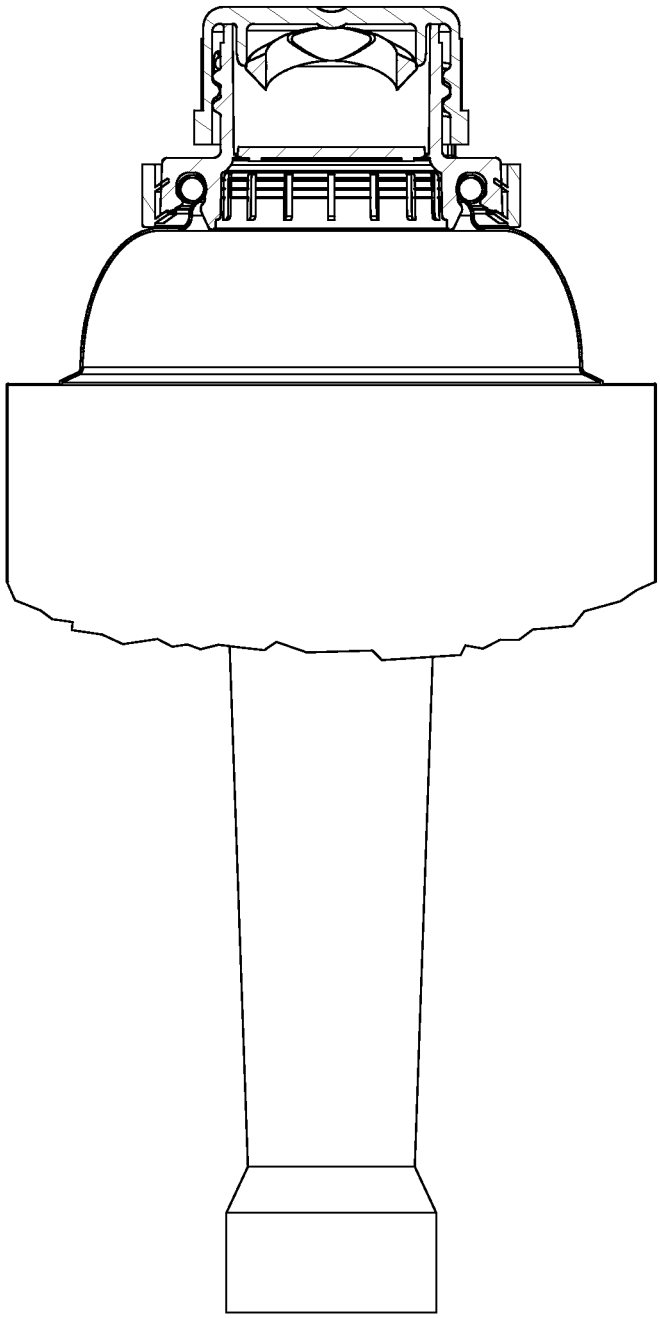
FIG. 10 is a side elevational view, in partial section, of the FIG. 8 assembly.
Figure 11:
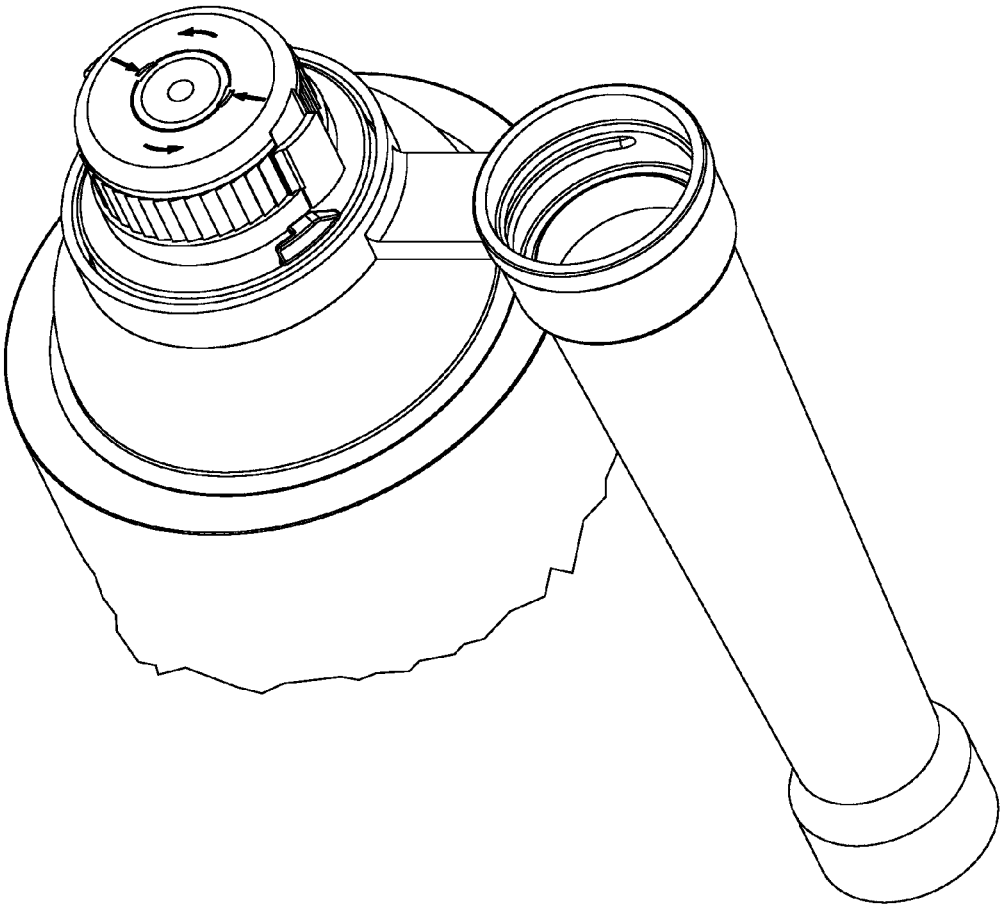
FIG. 11 is a perspective view of the FIG. 8 assembly.
Figure 12:
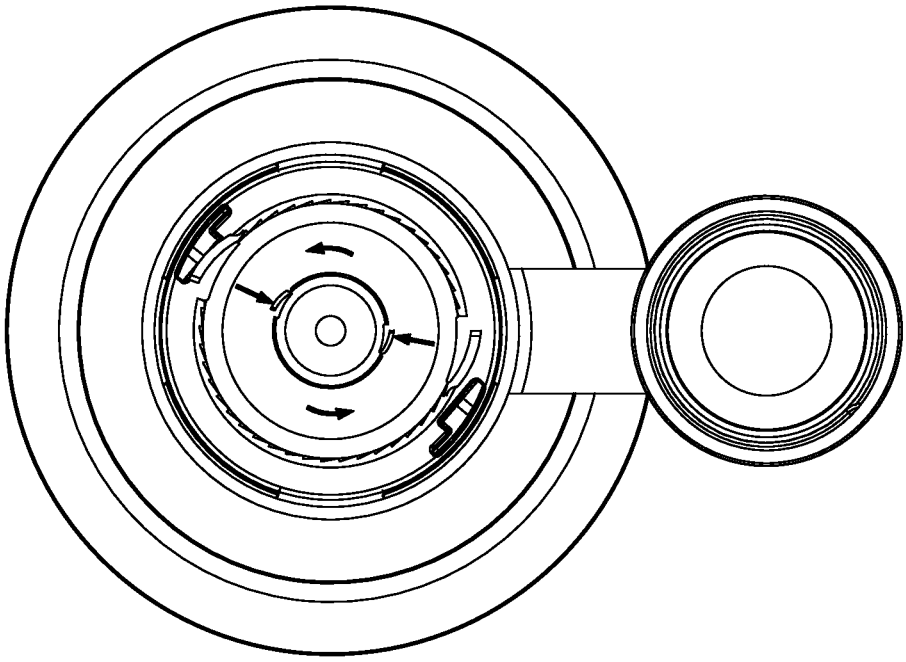
FIG. 12 is a top plan view of the FIG. 8 assembly.
Figure 13:
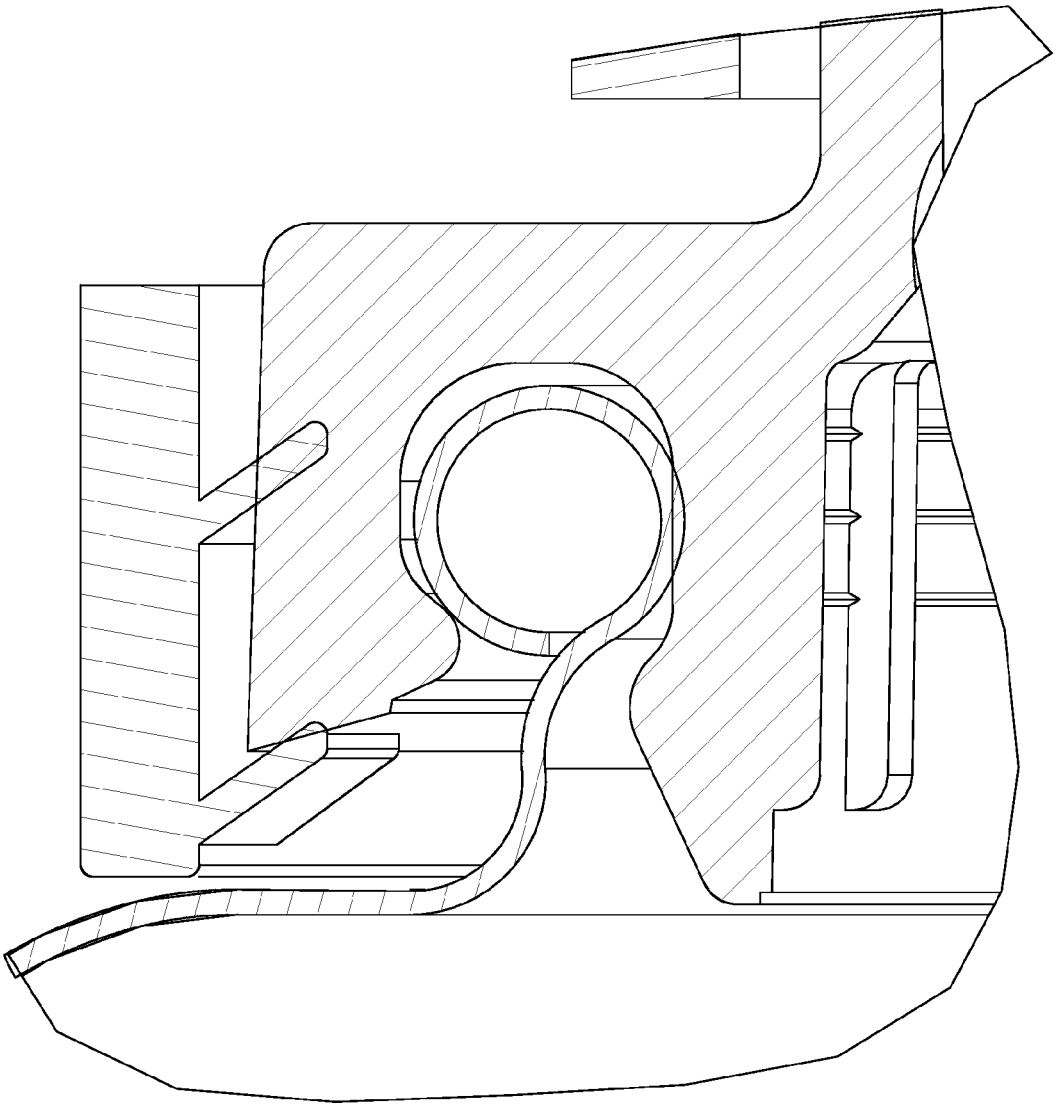
FIG. 13 is a detail illustration, in full section, showing the specific assembly interaction between the securing ring and the neck insert.

The FIG. 7 illustration provides more specific information regarding the geometry of the base 50 of the connection end 28. Included as part of this base construction is an inner supporting annular ring 74 which is used to push or keep the threaded engagement more secure than what might be provided by only a flat surface at this location. FIG. 13 provides a bottom plan view of funnel 20 and shows the generally concentric form of inner wall 54 within outer wall 56.

FIGS. 8-13 illustrate the manner in which the securing ring 24 presses onto the plastic neck insert 44 which is assembled to an upper finish of the fuel additive can 46 which in the exemplary embodiment is a metal can, though the scope of the disclosed embodiments of this invention are suitable for use with any type of fuel additive container. The upper finish of the fuel additive can 46 includes a rolled edge 76 and the neck insert 44 snaps down over that rolled edge 76, see FIG. 13. The neck insert 44 as assembled onto the rolled edge 76 provides a generally cylindrical outer wall surface 78 and an annular gap 80 or annular relief located below the outer wall surface 78. As is illustrated, each of the four tabs 66 snap in beneath the neck insert 44 and extend into the annular gap 80. The use of plastic for funnel 20 and the relatively thin wall thickness of each tab 66 combined with the upward incline yields sufficient flexibility to each tab 66 for the desired deflection as those four tabs 66 slide over the neck insert 44 and then assemble the securing ring 24 with a snap-fit as the four tabs 66 fit into the annular gap 80.

As this press-on, snap-fit assembly of the securing ring 24 to the plastic neck insert 44 occurs, the two abutment tabs 70 are positioned in abutment against the outer wall surface 78 of the neck insert 44. The pressure exerted by the outer wall surface 78 on these two oppositely-disposed abutment tabs 70 creates a limited degree of ovalizing in the shape of the securing ring 24. If one thinks of an oval or ovalizing shape similar to that of an ellipse, there is in fact a longer axis or what is referred to as a major axis and a shorter or minor axis. Using these reference terms, the major axis of the oval is increased in length over the starting diameter of the circular or cylindrical form of securing ring 24. Correspondingly, the length or dimension of the minor axis is decreased relative to the starting circular form of securing ring 24. This decrease in length actually pulls the two intermediate tabs 66 into tighter engagement in the annular gap 80 and thereby more tightly and securely anchors the securing ring 24 to the neck insert 44.

When it is intended to remove the funnel 20 from the fuel additive can 46, the user simply pulls the securing ring 24 off of the neck insert 44. Squeezing inwardly along the major axis from opposite sides of the securing ring 24 should restore the ovalized shape of securing ring 24 into something more circular or cylindrical and thereby facilitate removal of the securing ring 24.

Also illustrated in FIGS. 8-12 are other features of the typical fuel additive product. A tear-out or pull-out diaphragm 82 is shown as well as a threaded closing cap 48. The neck insert 44 surrounds the tear-out diaphragm 82 and provides a raised neck finish 84 which is externally threaded for receipt of the threaded closing cap 48. When it is time for the user to add the fuel additive to the gas tank, the funnel is removed from the neck insert, the threaded closing cap 48 is removed, the diaphragm 82 is pulled out and the connection end 28 is securely threaded onto the neck finish 84 of the neck insert 44. The fuel additive can 46 is then tilted as the inserting end 30 of the funnel 20 which is now secured to the neck finish 84 is directed toward to the capless fitment and the two projecting buttons which need to be engaged and released.

Figure 15:
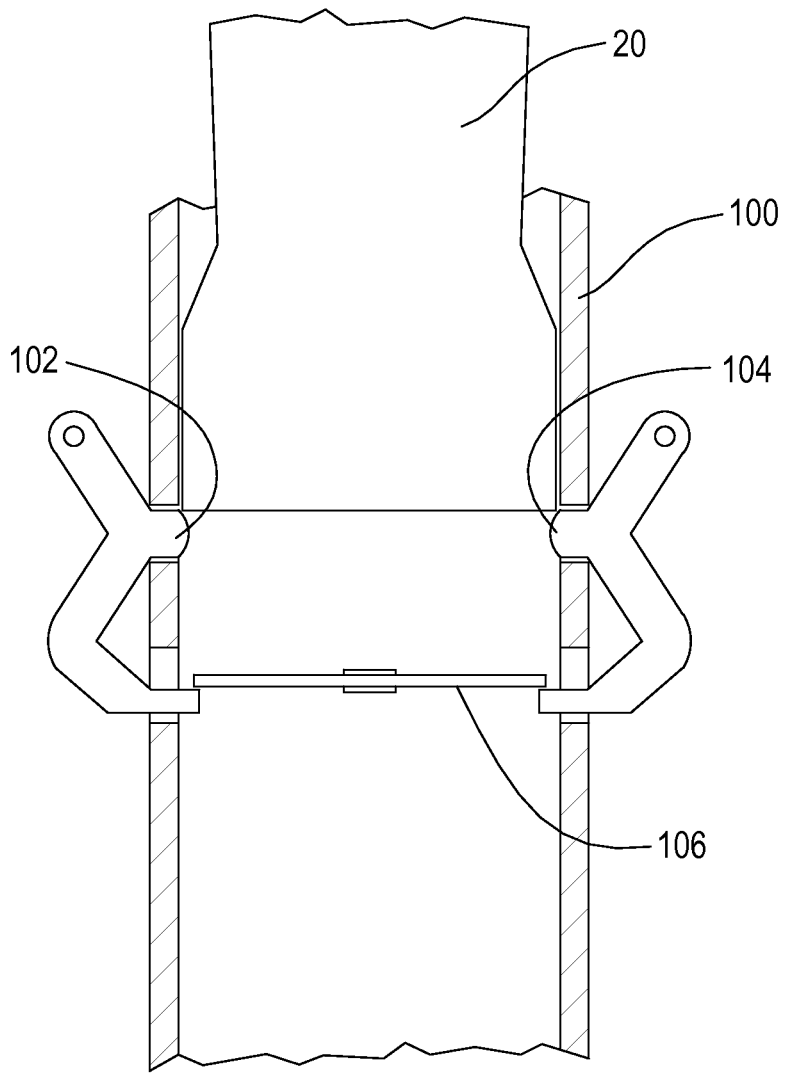
FIG. 15 is a diagrammatic, front elevational view, in full section, of the FIG. 1 funnel being inserted into a capless fitment.
Figure 15A:
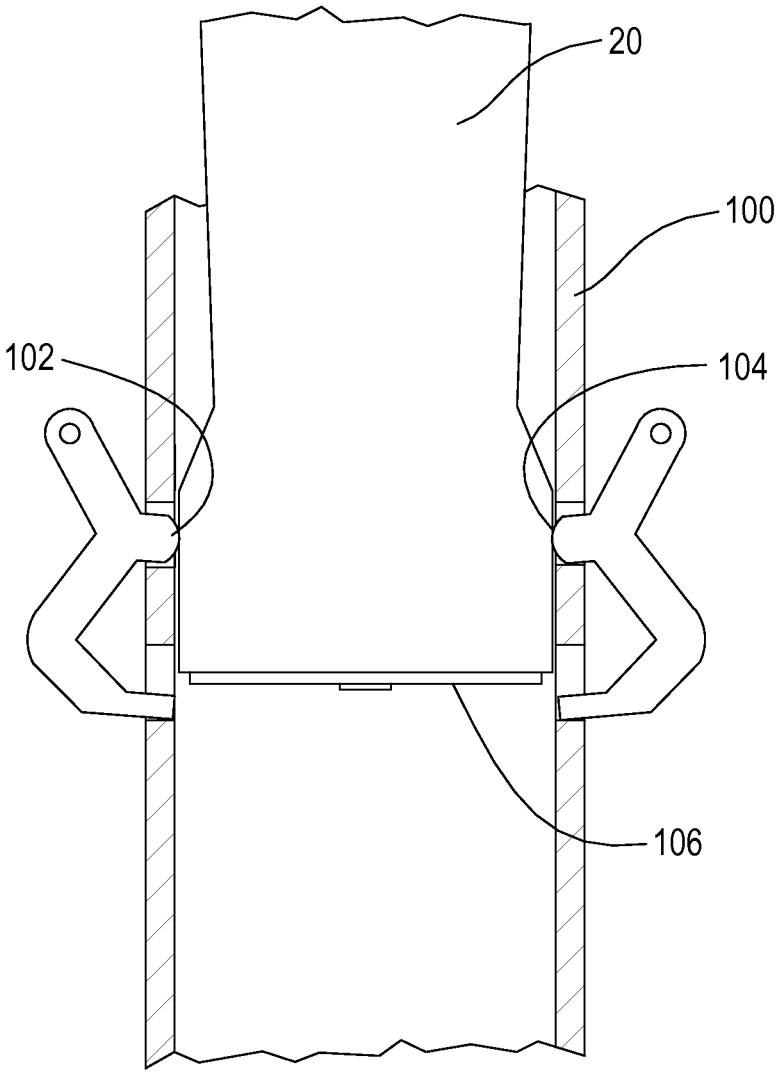
FIG. 15A is a diagrammatic, front elevational view, in full section, of the FIG. 1 funnel with the release projections engaged.
Figure 16:
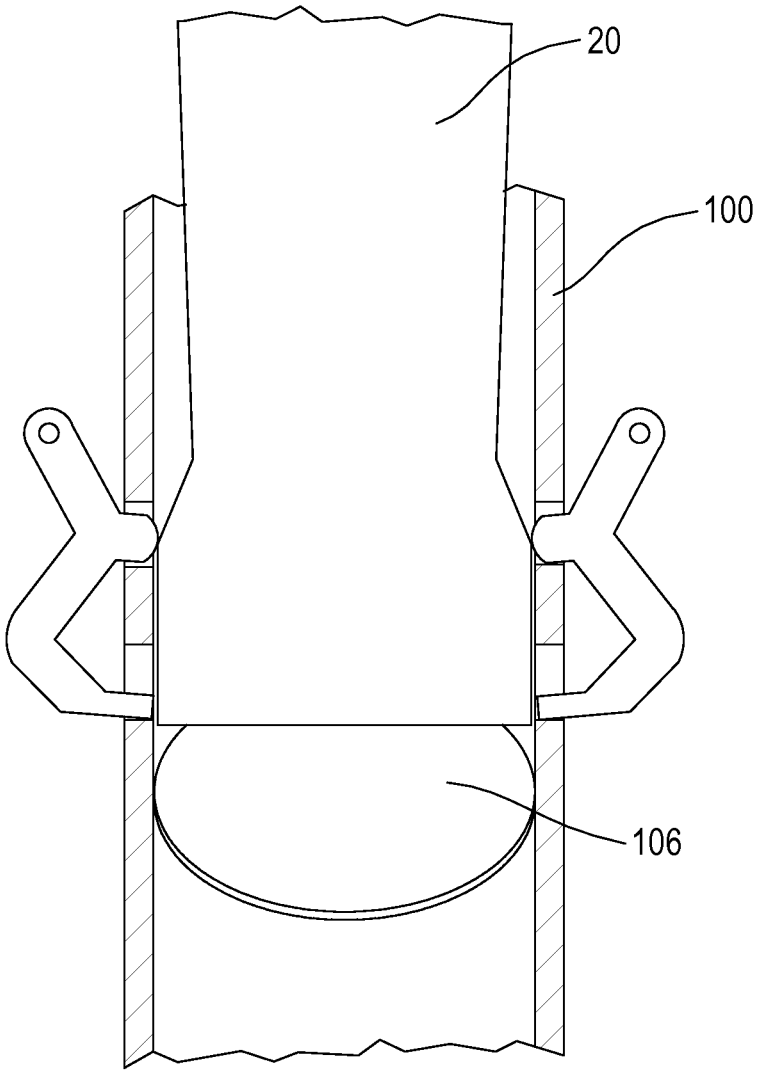
FIG. 16 is a diagrammatic, front elevational view, in full section, of the FIG. 1 funnel after release of an internal closing flap.
Figure 16A:
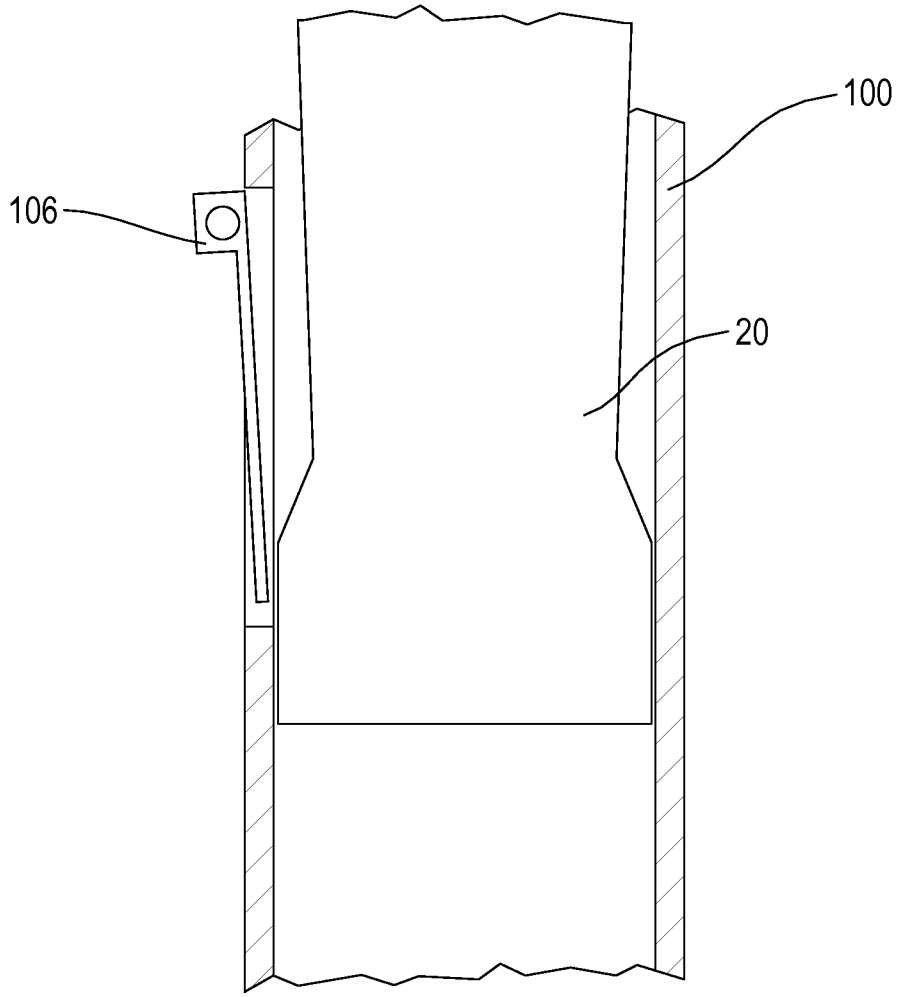
FIG. 16A is a diagrammatic, side elevational view, in full section, of the FIG. 1 funnel fully inserted.
Figure 17:
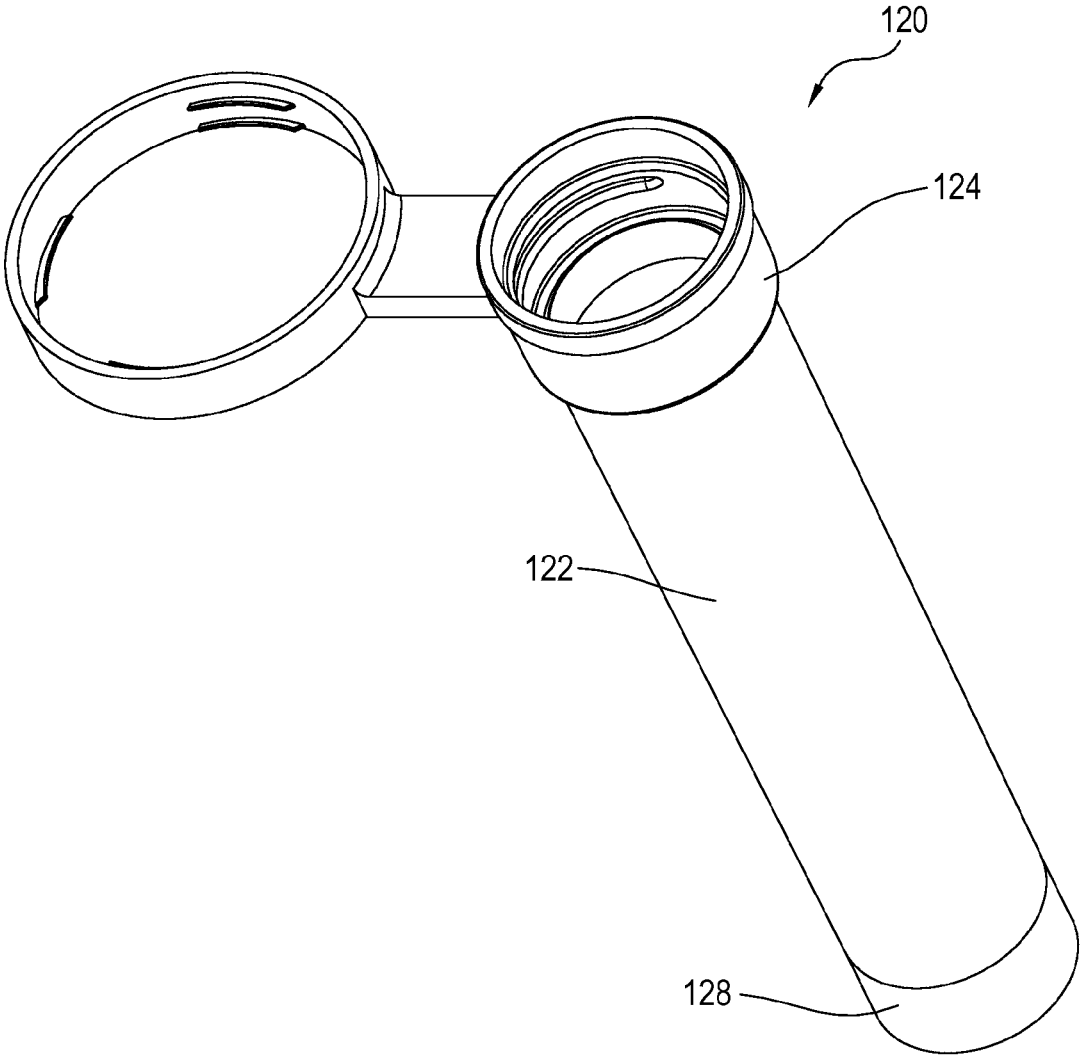
FIG. 17 is a perspective view of a funnel according to another embodiment of the present invention.
Figure 18:
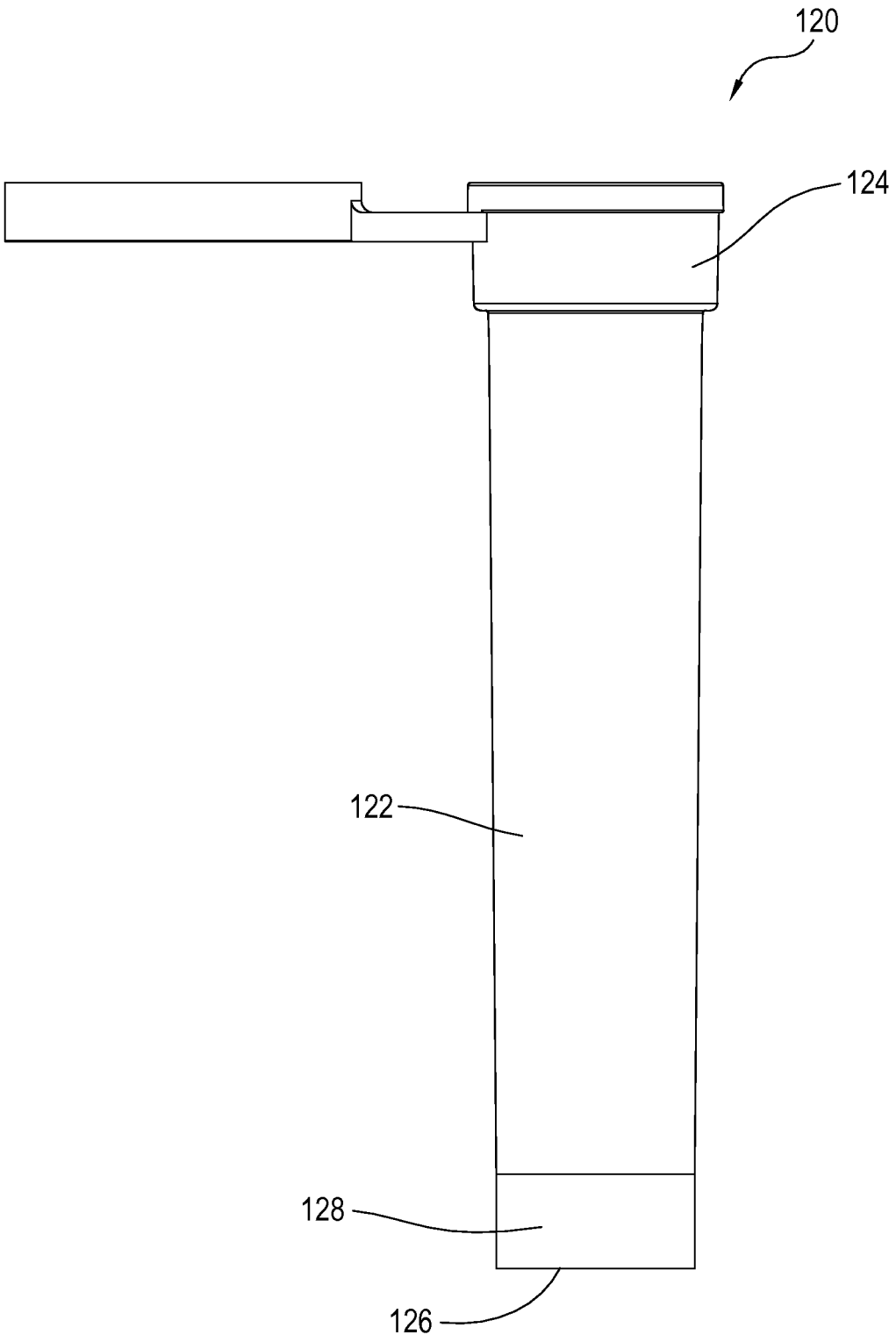
FIG. 18 is a front elevational view of the FIG. 17 funnel.
Figure 19:
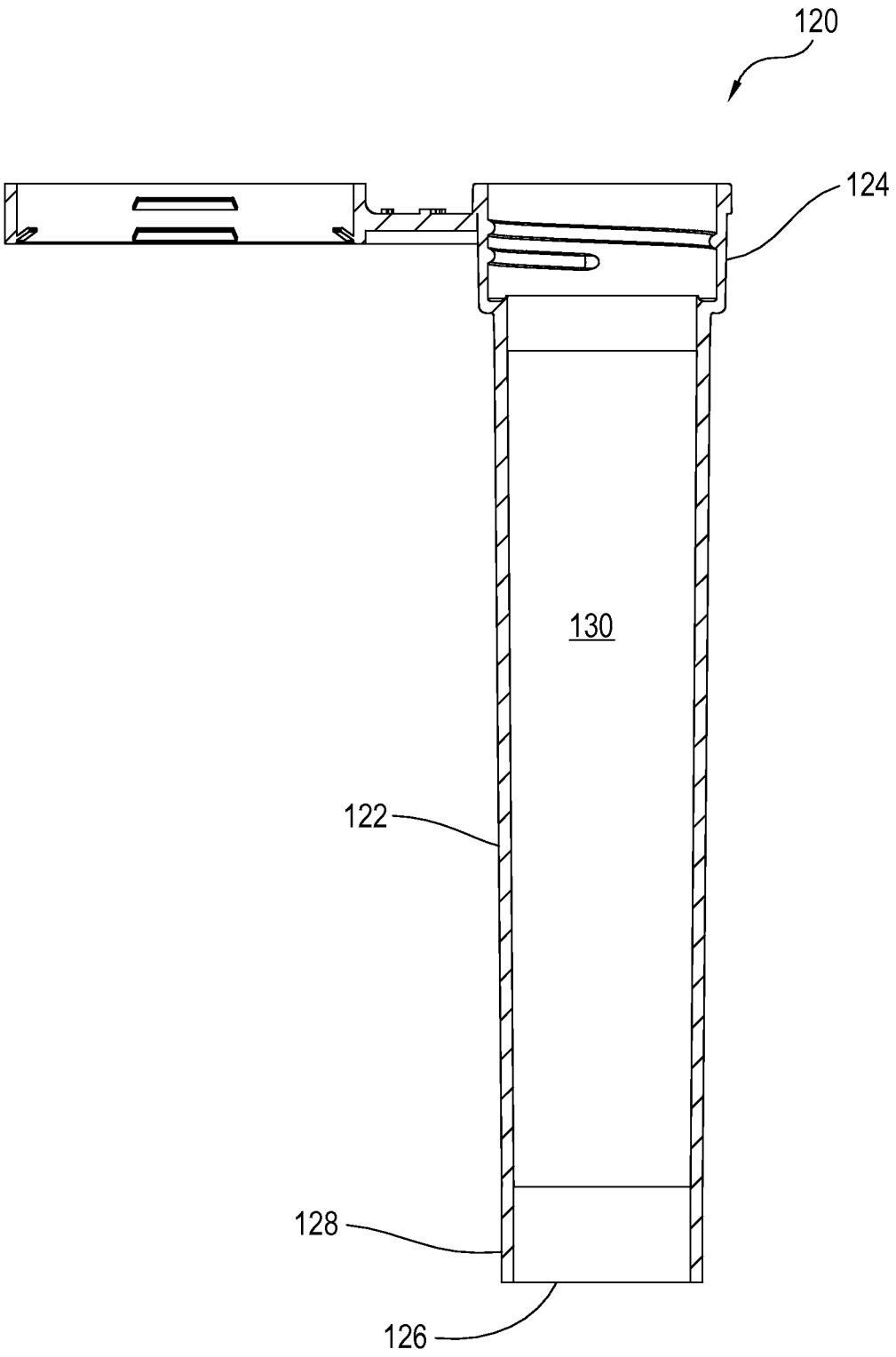
FIG. 19 is a front elevational view, in full section, of the FIG. 17 funnel.
Figure 20:
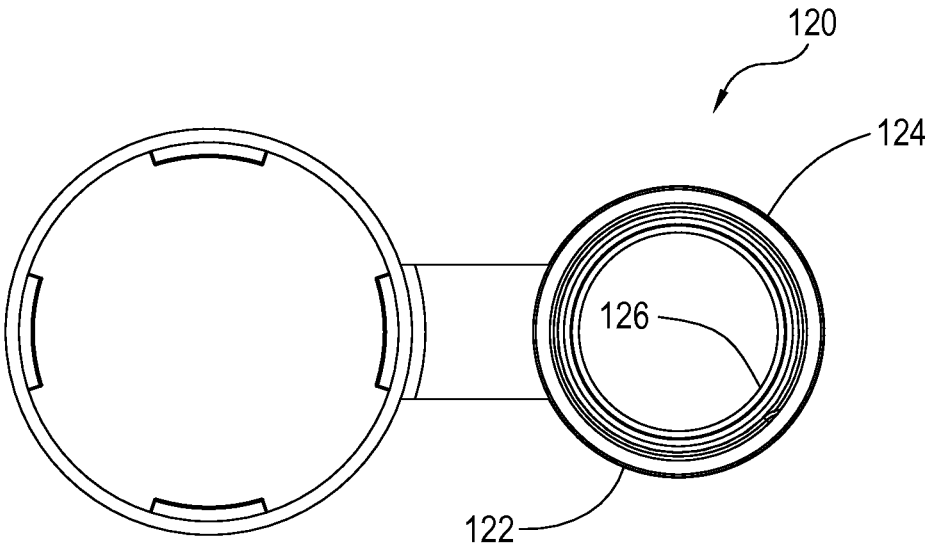
FIG. 20 is a top plan view of the FIG. 17 funnel.
Figure 21:
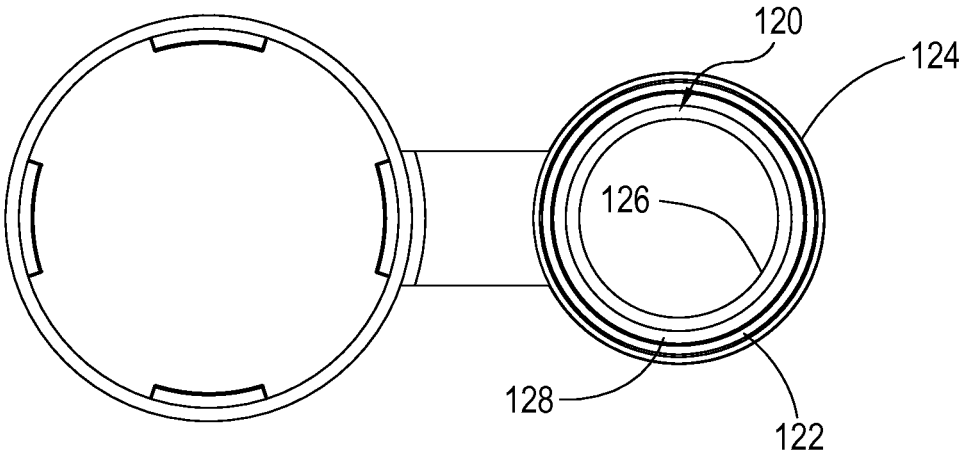
FIG. 21 is a bottom plan view of the FIG. 17 funnel.

Referring now to the diagrammatic representations of FIGS. 15, 15A, 16 and 16A, the stages of the insertion, release and opening procedure are illustrated in cooperation with a representative capless fitment 100. In FIG. 15 the funnel 20 has been initially removed from the additive container and securely threaded onto the neck finish of that additive container. The additive container has already been opened and the container with the funnel attached is then inverted and is in the process of being inserted into the capless fitment 100. The two release projections 102 and 104 have not yet been engaged by the inserting end of the funnel 20. However, the relative sizes which are illustrated in FIGS. 15 and 15A make it clear that with continued advancing of the inserting end of the funnel, the two release projections 102 and 104 will be engaged by the inserting end of the funnel and these two release projections will be pushed radially outwardly. This outward radial movement of each release projection 102 and 104 is intended to be a diagrammatic representation of a selected release mechanism, regardless of the specific construction. It is acknowledged that various release mechanisms could be employed and the key element with regard to this design is that some type of release projection must be engaged by the inserting end of the funnel in order to actually unlock or release the closing flap which in turn would allow the additive to be delivered into the gas tank. The two illustrated release projections 102 and 104 could take on the form of ball detents or other similar spring projections. Whatever the selected mechanism, release of these two projections 102 and 104 results in release or unlocking of the closing flap 106 of the capless fitment 100. Closing flap 106 is normally (biased) closed and locked. Release of the two projections 102 and 104 releases the locked status, but the closing flap 106 is still spring-biased closed. However, the closing flap 106 is able to be pushed (hinged) to an open condition by the inserting end of the funnel as is diagrammatically illustrated in FIGS. 16 and 16A.

It is to be understood that the diagrammatic representations or illustrations of FIGS. 15, 15A, 16 and 16A are intended to simply depict the functional nature of what occurs when the inserting end of the funnel 20 is inserted into the capless fitment. The closing flap of the capless fitment is spring-biased and hinged into a closed and locked condition. The locking mechanism which may be one of several possible constructions, needs to be released first by insertion of the inserting end of the funnel before the funnel engages the closing flap. If the inserting end of the funnel is too small in its outside diameter measurement, it will not engage the releasing projections or buttons or ball detents, etc., whatever is being used. If the inserting end of the funnel is too large, it will not fit not the capless fitment opening. These constraints force a tight tolerance range on the outside diameter dimension of the inserting end of the funnel.

It is to be noted that whatever the fitment opening or release mechanism might be, funnel 20 is adaptable. The inserting end 30 of funnel 20 is designed to mimic the design of the gasoline pump nozzle. Therefore so long as the construction of the capless fitment is compatible with a gasoline pump nozzle, such that the nozzle is able to open the capless fitment, funnel 20 will also be capable of doing so in essentially the same manner.

Referring to FIGS. 17-21, another fuel additive funnel embodiment according to the present invention is illustrated. Funnel 120 is functional equivalent in virtually all respects to funnel 20 in terms of its overall size, shape and construction. One structural difference between funnel 120 and funnel 20 is that funnel 120 does not include any annular skirt, such as skirt 34. Another structural difference between funnel 120 and funnel 20 is that the body of funnel 120 is generally straight (i.e., a straight cylinder).

The body 122 of funnel 120 is substantially straight from its upper portion 124 to its lower edge 126 which is the distal portion or edge of inserting end 128. The hollow interior 130 has a slight taper for core removal. The tapered portion may begin at either end and narrows as it extends to the opposite end. Another option is to taper from each end, narrowing toward the center. This would require core removal from each end.

As with funnel 20, funnel 120 has an inserting end which is sized and shaped so as to fit within the inlet opening of the fitment and at the same time is large enough to engage the two release projections 102 and 104. As described in conjunction with funnel 20, the inserting end of the funnel needs to be sized correctly so that it will both move into the inlet opening of the fitment 100 and at the same time be large enough so as to engage and release the two release projections 102 and 104. Funnel 120 has all of the requisite sizes and shapes in order to accomplish this functional objective. As noted, the primary difference is that funnel 120 does not include the annular skirt configuration which is found as part of funnel 20.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A funnel for use in dispensing a flowable product into a receptacle with a flow inlet which is normally-closed, said funnel comprising:

an inlet portion for receiving said flowable product;

an inserting end portion for insertion into said flow inlet;

a body portion extending between said inlet portion and said inserting end portion, said body portion defining a tapered hollow interior; and wherein said inserting end portion includes a double-walled skirt which is constructed and arrange for opening said flow inlet upon insertion of said inserting end into said flow inlet, said double-walled skirt including an inner annular wall and an outer annular wall.

2. The funnel of claim 1 wherein said funnel is a single-piece, molded plastic component.

3. The funnel of claim 1 wherein said inserting end portion is constructed and arranged with said outer annular wall being joined to said body portion by an annular tapered portion.

4. The funnel of claim 1 wherein said inlet portion is internally threaded for threaded connection to a supply source of said flowable product.

5. The funnel of claim 1 wherein said skirt has an outer diameter size which is suitable for engagement with a release button of a capless fitment.

6. The funnel of claim 1 which further includes a securing ring for attachment of said funnel to a supply source of said flowable product.

7. The funnel of claim 6 wherein said securing ring is connected to said inlet portion.

8. The funnel of claim 7 which further includes a connector tab for connecting said securing ring to said inlet portion.

9. The funnel of claim 6 wherein said securing ring includes a plurality of inwardly extending tabs.

10. The funnel of claim 9 wherein said plurality of inwardly extending tabs are constructed and arranged for connecting said funnel to a neck insert which is part of a supply source container.

11. The funnel of claim 10 which further includes a plurality of abutment tabs constructed and arranged for engaging said neck insert.

12. An injection-molded funnel for use in dispensing a flowable product from a container into a receptacle which includes a normally-closed capless fitment, said funnel comprising:

a connecting end portion including a securing ring for assembling said connecting end portion to a portion of said container, said securing ring including abutment tabs for engaging said container to ovalize the shape of said securing ring;

an inserting end portion for insertion into said capless fitment;

a tubular body portion in flow communication with said connecting end portion and in flow communication with said inserting end portion; and wherein said inserting end portion is constructed and arranged for opening said normally closed capless fitment.

13. The injection-molded funnel of claim 12 wherein said inserting end portion includes a skirt.

14. The injection-molded funnel of claim 13 wherein said normally-closed capless fitment includes a release button and said skirt has a size and shape for engaging said release button.

15. The injection-molded funnel of claim 12 which further includes a connector tab for connecting said securing ring to said connecting end portion.

16. The injection-molded funnel of claim 12 wherein said securing ring includes a plurality of inwardly extending tabs.

17. The injection-molded funnel of claim 16 wherein said plurality of inwardly extending tabs are constructed and arranged for connecting said funnel to a neck insert which is part of said container.

18. The injection-molded funnel of claim 17 wherein said abutment tabs are axially spaced from said inwardly extending tabs.

* * * * *